United States Patent [19]

Liaw

[11] 4,246,658

[45] Jan. 27, 1981

[54] CORD NECKTIE

[76] Inventor: Wan-Yium Liaw, 26 Hsin Tien Road, Hsin Hsing Site, Kao Shung, Taiwan

[21] Appl. No.: 44,393

[22] Filed: May 31, 1979

[51] Int. Cl.[3] ..... A41D 25/14

[52] U.S. Cl. ..... 2/152 R

[58] Field of Search ..... 2/152 R, 152 A, 153, 2/154, 155, 156, 144, 145

[56] References Cited

U.S. PATENT DOCUMENTS

| | | | |
|---|---|---|---|
| 1,225,257 | 5/1917 | Lepine | 2/152 A |
| 3,173,148 | 3/1965 | Horeii | 2/145 |
| 4,106,123 | 8/1978 | Freedman | 2/152 R |

FOREIGN PATENT DOCUMENTS

| | | | |
|---|---|---|---|
| 242146 | 4/1946 | Switzerland | 2/152 R |
| 14721 | of 1909 | United Kingdom | 2/152 A |

*Primary Examiner*—H. Hampton Hunter

[57] ABSTRACT

This invention relates to a cord necktie, particularly to a necktie which is provided with a cord, a knot plate and a band of decorative fabric. The knot plate is provided with four holes for the cord to pass through. The band of decorative fabric connected at one end of the cord, can be wound around the knot plate to form a permanent knot. In use, it is only required to pull the free end of the cord to tighten the necktie, or to pull the other part of cord to loose it.

1 Claim, 6 Drawing Figures

CORD NECKTIE

BACKGROUND OF THE INVENTION

The conventional necktie is a narrow band of decorative fabric. In use, the conventional necktie is worn around the neck, under the collar and tied in front to hang down the front of a shirt. When not in use, it is loosed entirely. Therefore, the knot near the top button of the shirt has to be formed again each time when the necktie is to be used. It is really inconvenient and time consuming. In addition, the conventional necktie would get wrinkled through frequent manual operation.

SUMMARY OF THE INVENTION

An object of the invention is to remove the drawbacks of the conventional necktie and to provide a cord necktie.

Another object of the invention is to provide a cord necktie which knot is not necessary to be formed again when the necktie is to be used.

Still another object of the invention is to provide a cord necktie which applies a cord to adjust the looseness and tightness of the necktie.

Other objects and advantages of the invention will be evident from the following detailed description when read in conjunction with the accompanying drawings and when read in conjunction with the appended claims.

DETAILED DESCRIPTION OF THE INVENTION

Figure 1:
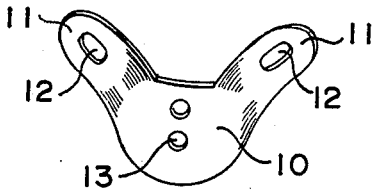
FIG. 1 is an elevational view of the knot plate according to the invention.
Figure 2:
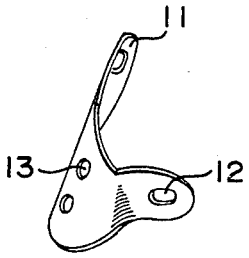
FIG. 2 is a perspective view of the knot plate according to the invention.

As shown in FIGS. 1 and 2, both sides of the knot plate 10 bend slightly backward. The knot plate 10 is provided with two flanges 11—11 inclined upward, each of which has a slot 12. In the middle portion of the knot plate 10, there are vertically provided two apertures 13—13.

Figure 3:
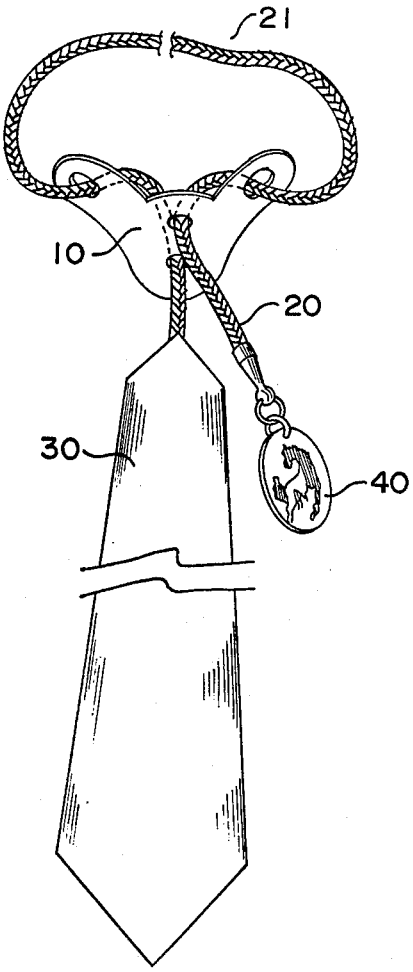
FIG. 3 illustrates how a cord, a knot plate and a band of decorative fabric according to the invention are assembed with one another.
Figure 6:
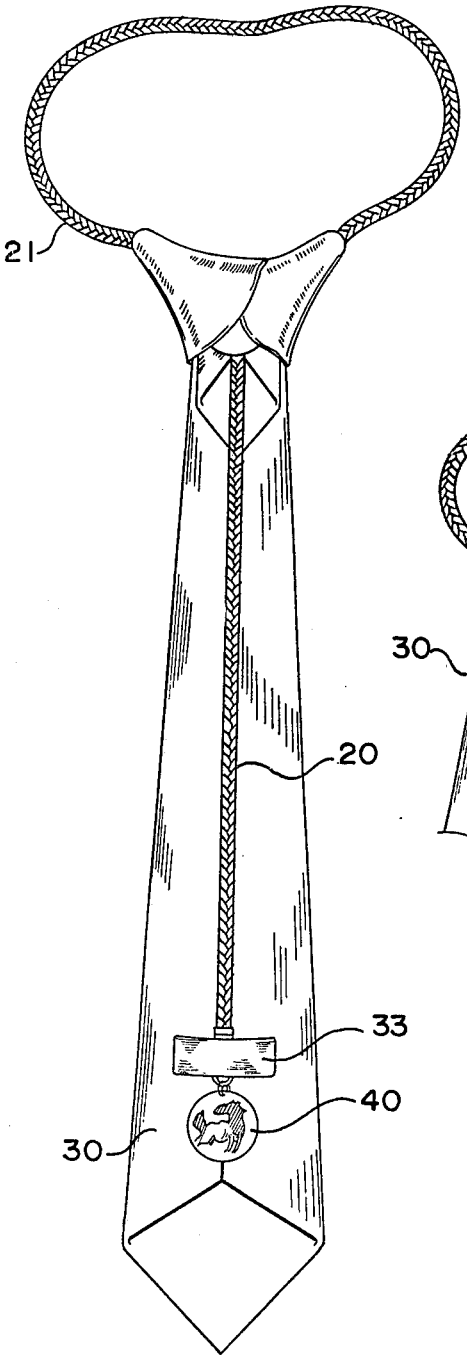
FIG. 6 is a back view of the tied cord necktie according to the invention.

As shown in FIG. 3, two ends of the cord 20 respectively pass through two slots 12—12 into the backside of the knot plate 10. Then, two ends of the cord 20 respectively pass further through two apertures 13—13 into the front of the knot plate 10. In the meantime, one end of the cord 20 is connected to a necktie 30, while the other end can be provided with a medal 40 for appearance sake. As shown in FIG. 6, a brand label is referred as 33, which is provided at the back of the necktie 30 to allow the insertion of the cord 20.

Figure 5:
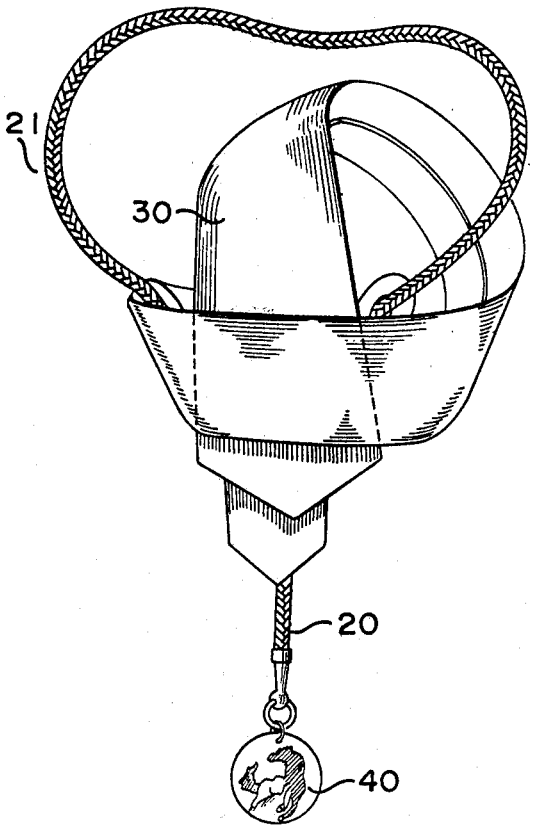
FIG. 5 illustrates the next stage of tying a knot according to the invention.
Figure 4:
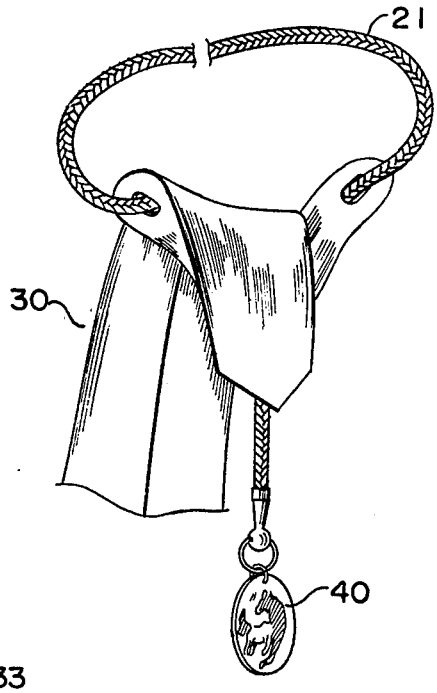
FIG. 4 illustrates the initial stage of tying a knot according to the invention.

FIGS. 4 and 5 show how to form a permanent knot according to the invention. First, it is required to wind the necktie 30 around the left flange 11 and then over the front of the knot plate 10. Second, the necktie 30 is wound around the right flange 11 and then passed through the knot hole formed by parts of the necktie 30 and the knot plate 10 as shown.

As shown in FIG. 6, after the permanent knot is formed, a cord ring 21 is formed above the knot plate 10. The size of the cord ring 21 is adjustable by pulling or releasing the cord 20. In use, it is only required to wear the cord ring 21 under the collar and pull tight the cord 20. The necktie 30 can be released by pulling the knot downward aside.

What I claim is

1. A cord necktie comprising:

a knot plate having a body and a pair of wings with a closed elongate slot defined in each wing and a pair of vertically spaced closed apertures defined in said body, said wings each curving backwardly and upwardly from said body to be inwardly concave in shape, said slots each having a longitudinal axis oriented along the length of said each wing toward said body;

a cord threaded through said apertures and said slots to have both ends thereof extending through said apertures outwardly of said knot plate, said cord having a body portion located outwardly of said knot plate and forming a loop which fits around a wearer's neck; and a necktie attached to one end of said cord, said necktie being adapted to be wound around said knot plate to form a necktie knot about said knot plate.

* * * * *